US005609125A

United States Patent [19]

Ninomiya

[11] Patent Number: 5,609,125

[45] Date of Patent: Mar. 11, 1997

[54] APPARATUS FOR CONTROLLING AN ELECTRICALLY OPERATED COOLING FAN USED FOR AN ENGINE COOLING DEVICE

[75] Inventor: Masahito Ninomiya, Toyota, Japan

[73] Assignee: Toyota Jidosha Kabushiki Kaisha, Toyota, Japan

[21] Appl. No.: 655,113

[22] Filed: May 29, 1996

[30] Foreign Application Priority Data

May 31, 1995 [JP] Japan ..... 7-134135

[51] Int. Cl.[6] ..... F01P 7/02

[52] U.S. Cl. ..... 123/41.12

[58] Field of Search ..... 123/41.12

[56] References Cited

FOREIGN PATENT DOCUMENTS 58-96119A 6/1983 Japan .
559946A 3/1993 Japan .

*Primary Examiner*—Noah P. Kamen
*Attorney, Agent, or Firm*—Kenyon & Kenyon

[57] ABSTRACT

An apparatus for controlling an electrically operated cooling fan used for a cooling device to cool an engine block by circulating cooling water between the block and a radiator. The apparatus includes an electronic control unit (ECU), which controls the fan, and a cooling water temperature sensor, which detects the cooling water temperature. The ECU energizes a motor to rotate the fan when the detected value of the cooling water temperature becomes equal to or higher than a predetermined value. The ECU starts measuring elapsed time when the fan begins to rotate. After the measured time reaches a predetermined second reference value, the ECU computes the altering rate of the cooling water temperature. If it is determined that the altering rate is lower than a predetermined third reference value, the ECU de-energizes the fan motor. Accordingly, the rotation of the fan is stopped when the altering rate of the cooling water temperature, measured after the fan starts rotation, is rather low. Therefore, the fan is only rotated when necessary.

29 Claims, 8 Drawing Sheets

APPARATUS FOR CONTROLLING AN ELECTRICALLY OPERATED COOLING FAN USED FOR AN ENGINE COOLING DEVICE

BACKGROUND OF THE INVENTION

1. Field of the Invention

The present invention relates to a water-cooled type cooling device that cools an engine block by circulating cooling water between the block and a radiator. More particularly, the present invention pertains to an apparatus for controlling an electrically operated cooling fan, which forcibly cools a radiator, in accordance with the temperature of the cooling water.

2. Description of the Related Art

An automobile engine is typically provided with a water-cooled type cooling apparatus. As shown in FIG. 9, such an apparatus includes a radiator 41, which transfers heat, a pump 42, which sends out pressurized cooling water, a thermostat 43, and pipes 44. When the engine is running, the pump 42 is activated to circulate cooling water through an engine block 45, the radiator 41, the thermostat 43, and the pipes 44. The circulation of the cooling water causes the heat of the block 45 to be transferred to the cooling water and cools the block 45. The heat of the cooling water is released into the ambient air by the radiator 41.

A typical radiator 41 is mounted at the front of an automobile 46. This enables an air stream, produced when the automobile 46 is moving, to cool the radiator 41. This, in turn, cools the cooling water passing through the radiator 41. A cooling fan 47 is provided adjacent to the radiator 41 to forcibly send a cooling current, which is required for heat transfer, to the radiator 41. When the car is stopped or when the air stream is insufficient, the fan 47 is rotated to cool the radiator 41.

A direct-drive type fan, which is driven by an engine's crankshaft, or an electrically operated fan, which is driven by an electric motor, is typically employed as the cooling fan. When the direct-drive type fan is used, the fan's rotating speed depends on the engine speed. Therefore, the flow rate of the air current produced by the fan does not necessarily correspond to the running condition of the engine. Contrarily, when an electrically driven fan is used, the fan's rotating speed is not dependent on the engine speed. Hence, it is possible to have the electrically operated fan produce an air current, the flow rate of which corresponds to the running condition of the engine. In addition, since the fan may be stopped when cooling is not required, the electrically operated fan is advantageous in that fan noise is not produced when the fan is stopped. Furthermore, since the electrically operated fan is separate from the engine, its location is not restricted by the location of the crankshaft.

An apparatus for controlling such an electrically operated fan is described in Japanese Unexamined Patent Publication No. 58-96119. This apparatus is shown in FIG. 10. The apparatus has a computer 51. The computer 51 controls the electric power supplied to a motor 53 of an electrically operated fan 52 from a battery 54. The detected values of the cooling water temperature and the running condition of the engine are input into the computer 51. The cooling water temperature is detected by a cooling water temperature sensor provided near the cooling water outlet of a radiator (not shown). When the cooling water temperature becomes equal to or higher than a predetermined upper limit value the computer 51 actuates a drive circuit which includes transistors TR1, TR2, TR3 and energizes the motor 53. When the cooling water temperature becomes lower than a predetermined lower limit value, the computer 51 de-energizes the motor 53. The computer 51 alters the value of the upper limit within a predetermined range in accordance with the running condition of the engine. Such structure enables the fan 52 to be rotated in accordance with various running conditions of the engine and allows optimal adjustment of the cooling water temperature.

The apparatus of the above publication may be employed in the cooling apparatus of FIG. 9. In such a case, the thermostat 43 is opened slightly when the cooling water temperature in the radiator 41 is lower than a predetermined value. This maintains the cooling water temperature measured near the cooling water outlet of the radiator 41 at a substantially constant value or at a temperature that changes slightly. In this state, the computer 51 operates the fan 52 if the cooling water temperature exceeds the predetermined upper limit value. Therefore, the computer 51 does not stop rotation of the fan 52 unless the cooling water temperature falls below the lower limit value regardless of whether the forced cooling causes the cooling water temperature to fall to a value close to the lower limit. Thus, the supply of electric power from the battery 54 to the motor 53 continues and the fan 52 keeps rotating. This causes unnecessary operation of the motor 53 and increases the power consumption of the motor 53. As a result, the electrical load on the alternator is increased. This increases the load on the engine and may decrease the engine's fuel consumption. In addition, unnecessary fan rotation prolongs the fan noise.

SUMMARY OF THE INVENTION

Accordingly, it is a primary objective of the present invention to optimally control the cooling of a radiator when necessary by stopping the rotation of the fan in accordance with a rate of alteration in cooling water temperature. Another objective is to optimally control the cooling of the radiator if necessary by stopping the rotation of the fan in accordance with the running condition of the engine.

To achieve the foregoing and other objects and in accordance with the purpose of the present invention, an apparatus for controlling an electrically operated cooling fan used for an engine cooling device is provided. The engine has a block and a water jacket in the block, wherein the water jacket includes an inlet and an outlet. The cooling device has a radiator, a first water passage, a second water passage and a water pump. The radiator has an inlet and an outlet. The first water passage serves to connect the outlet of the water jacket with the inlet of the radiator to supply the cooling water to the radiator from the water jacket. The radiator is adapted to receive the cooling water from the first water passage to facilitate heat exchange between air surrounding the radiator and the cooling water so as to decrease the temperature of the cooling water. The second water passage connects the outlet of the radiator with the inlet of the water jacket to return the cooling water to the water jacket from the radiator. The water pump is adapted to force the cooling water to pass through and out of the outlet of the water jacket to the first water passage. The cooling device circulates the cooling water between the block and the radiator to cool the block and wherein the apparatus controls the cooling fan to forcibly cool the radiator. The apparatus comprises detecting device for detecting a temperature of the cooling water; activating device for activating the cooling fan when the detected water temperature is in excess of a first predetermined reference value; measuring device for measuring an elapsed time from the actuation of the cooling fan, computing device for computing a variation rate based on the detected water temperature after when the elapsed time matches a second predetermined reference value; and deactivating device for deactivating the cooling fan when the variation rate is smaller than a third predetermined reference value.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

An apparatus for controlling an electrically operated cooling fan in an automobile will now be described with reference to the drawings.

Figure 1:
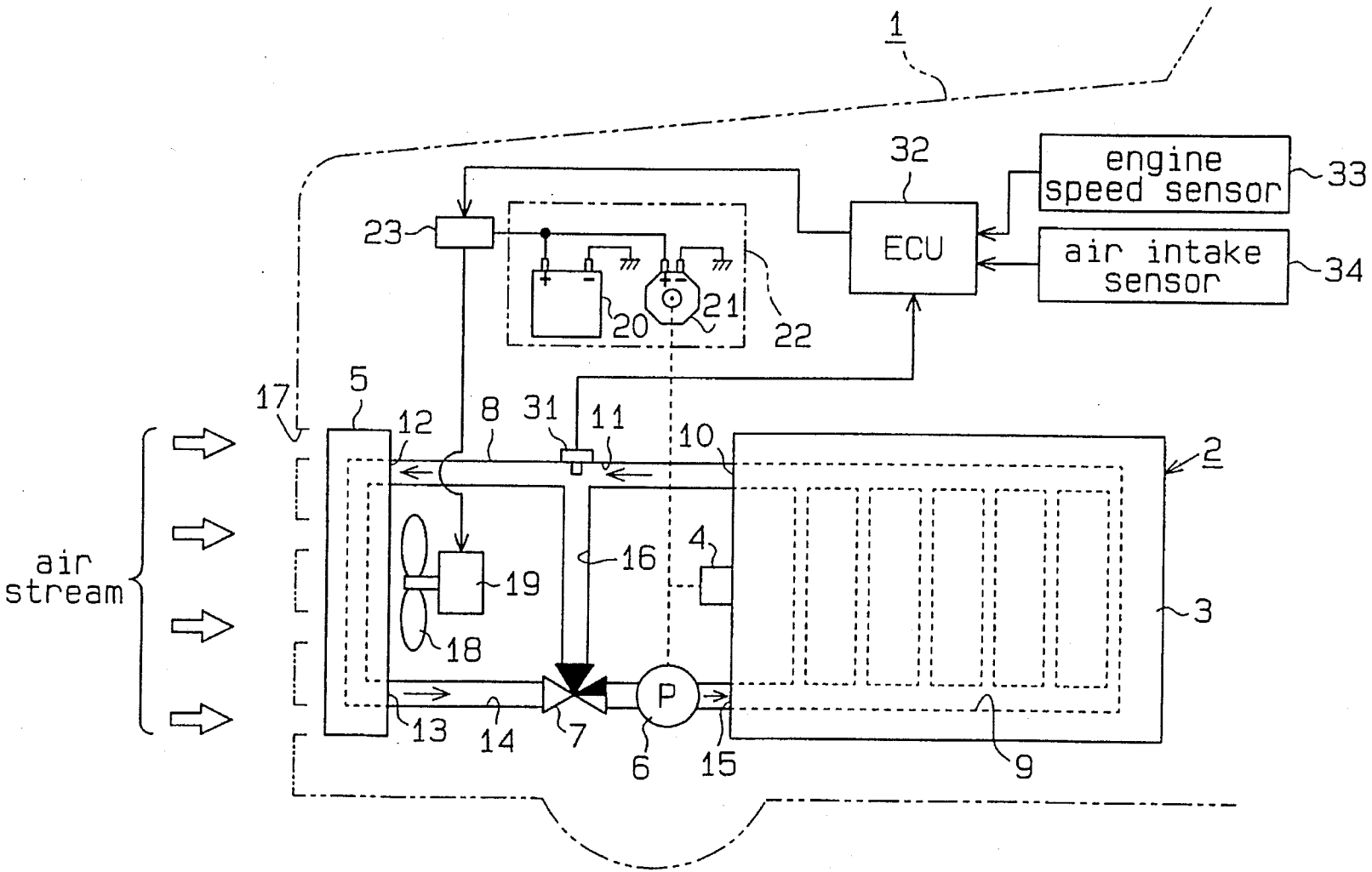
FIG. 1 is a schematic drawing showing a apparatus according to a first embodiment of the present invention.

FIG. 1 is a conceptual structural drawing of the apparatus according to a first embodiment. A gasoline engine 2 mounted in an automobile 1 has an engine block 3. Air-fuel mixture is supplied to a plurality of combustion chambers (not shown) defined inside the block 3 for combustion. Movement of pistons (not shown) caused by the combustion rotates a crankshaft 4. Heat is generated in the block 3 during the combustion of the mixture.

A water-cooled type cooling apparatus that cools the block 3 includes a radiator 5, which transfers heat, a cooling water pump 6, which sends out pressurized cooling water, a thermostat 7, and pipes 8. The apparatus further includes a water jacket 9 defined inside the block 3.

A first cooling water passage 11 extends from an outlet of the jacket 9 and leads into an inlet 12 of the radiator 5. A second cooling water passage 14 extends from an outlet 13 of the radiator 5 and leads into an inlet 15 of the jacket 9. The thermostat 7 and the pump 6 are located between the outlet 13 and the inlet 15. A bypass passage 16 extending from midway of the first cooling water passage 11 bypasses the radiator 5 and is connected with the thermostat 7. The cooling water of the cooling apparatus circulates through the members 5, 6, 7, 9 and the passages 11, 14, 16. In other words, when the engine 2 is running, the camshaft 4 causes the pump 6 to circulate the cooling water. Pressurized cooling water discharged from the pump 6 is sent to the jacket 9. The cooling water passes through the jacket 9 and then flows into the first cooling water passage 11.

The thermostat 7 consists of a three-way valve and is connected with passages 14, 16. The opening of the thermostat 7 is altered according to the value of the cooling water temperature THW. When the cooling water temperature THW is lower than a predetermined value, the thermostat 7 closes the second cooling water passage 14 and connects the bypass passage 16 with the cooling water passage 14. This returns the cooling water in the first cooling water passage 11, flowing out from the jacket 9, to the pump 6 without having it conveyed to the radiator 5. The returned cooling water is then pressurized and sent to the jacket 9 again by the pump 6. The circulating cooling water gradually becomes heated and thus warms the block 3. When the cooling water temperature THW becomes higher than the predetermined value, the thermostat 7 disconnects the bypass passage 16 from the second cooling water passage 14 and opens the cooling water passage 14. This causes the cooling water in the first cooling water passage 11 to flow through the radiator 5, the second cooling water passage 14, the thermostat 7 and the pump 6, where it is pressurized and sent to the jacket 9 again. The cooling water circulated in this manner causes heat to be transferred from the block 3 and thus cools it. The radiator 5 transfers the heat of the cooling water into the ambient air thus cooling the cooling water.

In this embodiment, the radiator 5 is located adjacent to a front grille 17 of the automobile 1. Therefore, when the automobile 1 moves, an air stream, which flows through the grille 17, cools the radiator 5. This, in turn, cools the cooling water passing through the radiator 5.

An electrically operated cooling fan 18, located adjacent to the radiator 5, sends forced air, required for heat transfer, to the radiator 5. Therefore, rotation of the fan 18 enables the radiator 5 to be forcibly cooled when the air stream does not flow toward the radiator 5 or when the flow of air is insufficient.

The fan 18 is driven by an electric motor 19. Thus, the fan 18 is rotated without regard to the speed of the engine 2, or the rotating speed of the crankshaft 4, since the motor 18 may be arbitrarily energized. This enables the flow rate of the current produced by the fan 18 to correspond with the running condition of the engine 2 without being regulated by the rotation speed of the crank shaft 4. When the radiator 5 does not require cooling, the rotation of the fan 18 may be stopped. This cuts off fan noise. Furthermore, the fan 18 may be positioned freely without being restricted by the location of the engine's crankshaft 4.

An apparatus for controlling the fan 18 is constituted in the following manner. A cooling water temperature sensor 31, located at the intersection of the first cooling water passage 11 and the bypass passage 16, detects the cooling water temperature THW. In this embodiment, the cooling water sensor 31 detects the cooling water temperature THW downstream of the outlet 10 of the jacket 9. (The temperature sensor 31 is located at a position where cooling water temperature switches were located in the prior art.) A power supply device 22 that includes a battery 20 and an alternator 21 supplies electric power to the motor 19 by way of a drive circuit 23. The drive circuit 23 and the battery 20 are connected electrically parallel to the alternator 21. The motor 19 is connected electrically to the drive circuit 23. The alternator 21 is connected to the crankshaft 4 and is activated by the engine 2, which serves as its power source. The drive circuit 23 is controlled by an electronic control unit (ECU) 32.

When the ECU 32 activates the drive circuit 23, electric power is supplied to the motor 19 from the battery 20 to rotate the fan 18. When the alternator 21 is driven by the crankshaft 4, the electric power produced by the alternator 21 is supplied to the battery 20 and the motor 19. A engine speed sensor 33, which detects the revolution speed of the crankshaft 4 (engine speed NE), and an air intake sensor 34, which detects a flow rate QA of air drawn into the combustion chambers of the engine 2, are connected to the ECU 32. Signals based on the detected values of the sensors 31, 33, 34 are fed into the ECU 32. The ECU 32 then controls the rotation of the fan 18 in accordance with the detected values. The ECU 32 also controls fuel injection, ignition timing, etc. in accordance with various signals of detected results to control the running condition of the engine 2. In other words, in this embodiment, the ECU 32 controls the engine 2 and the fan 18. The ECU 32 includes an input-output circuit, a central processing unit (CPU), and various memories. Control programs such as one that controls the engine 2 or one that controls the fan 18 are stored in the memories.

Figure 2:
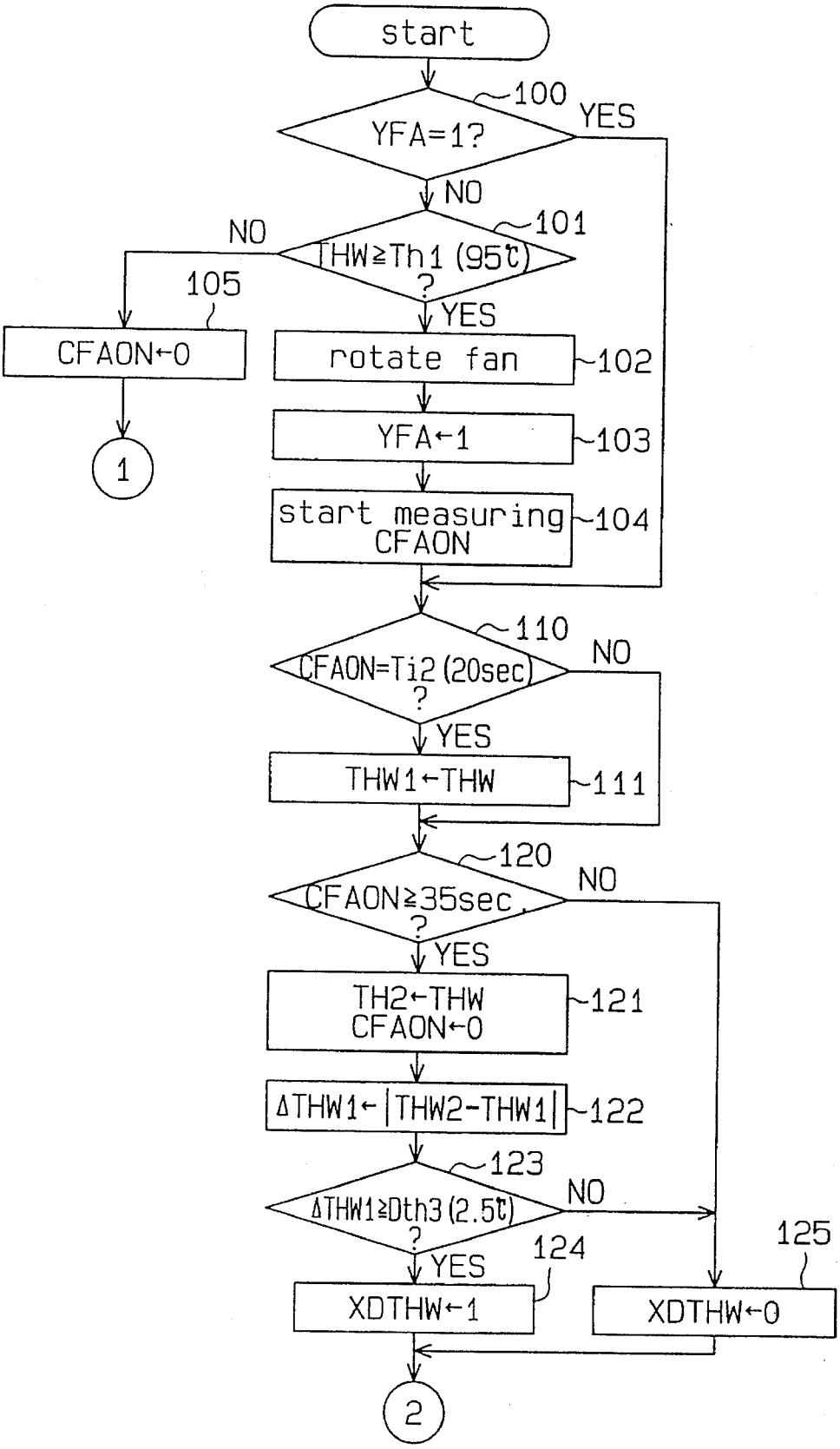
FIG. 2 is a flow chart showing a control routine.
Figure 3:
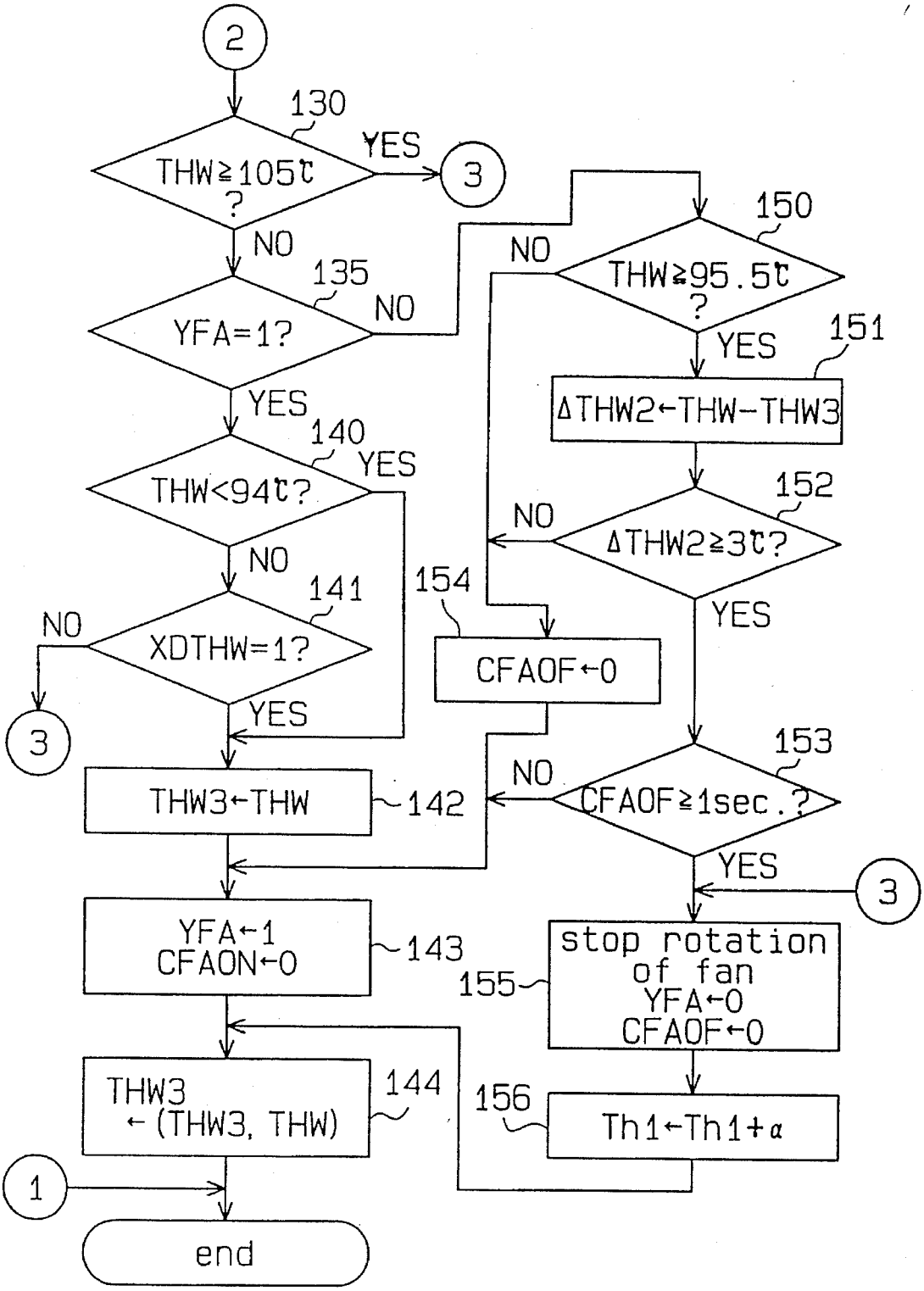
FIG. 3 is a flow chart showing the control routine continued from FIG. 2.

A control routine utilized to control the fan 18 in this embodiment is illustrated in FIGS. 2 and 3. The ECU 32 periodically executes the routine each time a predetermined period of time elapses.

The ECU 32 judges whether the fan flag YFA is set at "1" at step 100. The flag YFA is set at "1" when the fan 18 is rotated and "0" when the fan 18 is stopped. When it is determined that the flag YFA is "1", the ECU 32 proceeds to step 110 since the fan 18 is already rotating. When it is determined that the flag YFA is "0", the ECU 32 proceeds to step 101 since the fan 18 is not rotating.

At step 101, the ECU 32 judges whether the present cooling water temperature THW is equal to or higher than a predetermined first reference value Th1 of "95 degrees Celsius". When it is determined that the cooling water temperature THW is equal to or higher than "95 degrees Celsius", indicating that the radiator 5 requires cooling, the ECU 32 activates the drive circuit 23 to rotate the fan 18 at step 102. The ECU 32 sets the fan flag YFA to "1" at step 103. The ECU 32 starts measuring a first elapsed time CFAON beginning from when the fan 18 commenced rotation at step 104 and then proceeds to step 110.

When the cooling water temperature THW is lower than "95 degrees Celsius" at step 101, the radiator 5 does not require cooling. Therefore, at step 105, the ECU 32 resets the value of the first elapsed time CFAON to "0" and temporarily terminates subsequent processing.

From steps 100, 104, the ECU 32 proceeds to step 110 and judges whether the first elapsed time CFAON coincides with a second reference value Ti2 of "20 seconds". If the elapsed time CFAON is not "20 seconds", that is, if the elapsed time CFAON is shorter than or longer than "20 seconds", the ECU 32 proceeds to step 120. If the elapsed time CFAON is "20 seconds", the ECU 32 proceeds to step 111 and sets the value of a first cooling water temperature THW1 to a value equal to the present cooling water temperature THW. The ECU 32 then proceeds to step 120.

At step 120, the ECU 32 judges whether the elapsed time CFAON is equal to or longer than a predetermined reference value which is "35 seconds". If the elapsed time CFAON is shorter than "35 seconds", the ECU 32 proceeds to step 125. If the elapsed time CFAON is equal to or longer than "35 seconds", the ECU 32 proceeds to step 121 and sets the value of a second cooling water temperature THW2 to a value equal to the present cooling water temperature THW. The ECU 32 also resets the elapsed time CFAON to "0".

At step 122, the ECU 32 obtains the absolute value of the difference between the values of the second cooling water temperature THW2 and the first cooling water temperature THW1. The ECU 32 sets the value of a first altering rate ΔTHW1 to a value equal to the obtained value. In other words, the ECU 32 computes the first altering rate ΔTHW1 from the difference between the values of the cooling water temperature THW2, detected after 35 seconds from when the fan 18 commenced rotation, and the cooling water temperature THW1, detected after 20 seconds from when the fan 18 commenced rotation. In this case, due to the second cooling water temperature THW2 being lower than the first cooling water temperature THW1, the computed result of the difference between the second cooling water temperature THW2 and the first cooling water temperature THW1 shows a negative value.

At step 123, the ECU 32 judges whether the value of the first altering rate ΔTHW1 is equal to or higher than a third reference value Dth3 which is "2.5 degrees Celsius". When the value of the altering rate ΔTHW1 is equal to or higher than "2.5 degrees Celsius", the cooling effect of the fan 18 with respect to the radiator 5 is great. Thus, the ECU 32 proceeds to step 124 and sets the altering rate flag XDTHW as "1". When the value of the altering rate ΔTHW1 is lower than "2.5 degrees Celsius", the cooling effect of the fan 18 with respect to the radiator 5 is small. Thus, the ECU 32 proceeds to step 125.

When the ECU 32 proceeds to step 125 from steps 120, 123, the ECU 32 sets the altering rate flag XDTHW as "0".

After executing steps 124, 125, the ECU 32 judges whether the value of the present cooling water temperature THW is equal to or above a predetermined reference value of "105 degrees Celsius" at step 130. When it is determined that the cooling water temperature THW is equal to or above "105 degrees Celsius", the ECU 32 proceeds to step 155. If the cooling water temperature THW is lower than "105 degrees Celsius", the ECU 32 proceeds to step 135.

At step 135, the ECU 32 judges whether the fan flag YFA is set at "1". If the fan flag YFA is set at "0", which indicates that the fan 18 is not rotating, the ECU 32 proceeds to step 150. If the fan flag YFA is set at "1", which indicates that the fan 18 is rotating, the ECU 32 proceeds to step 140.

The ECU 32 judges whether the present cooling water temperature THW is lower than a predetermined value of "94 degrees Celsius" at step 140. When it is determined that the cooling water temperature THW is below "94 degrees Celsius", the ECU 32 proceeds to step 142. If the cooling water temperature THW is equal to or higher than "94 degrees Celsius", the ECU 32 proceeds to step 1.41.

At step 141, the ECU 32 judges whether the altering rate flag XDTHW is set at "1". When it is determined that the altering rate flag XDTHW is set at "0", which indicates that the cooling effect of the fan 18 with respect to the radiator 5 is small, the ECU 32 proceeds to step 155. If the altering rate flag XDTHW is set at "1", which indicates that the cooling effect of the fan 18 with respect to the radiator 5 is great, the ECU 32 proceeds to step 142.

The ECU 32 sets the value of a third cooling water temperature THW3 to a value equal to the present cooling water temperature THW at step 142. The third cooling water temperature THW3 is a value referred to when judging whether to stop the rotation of the fan 18. At step 143, the ECU 32 sets the fan flag YFA at "1" and resets the elapsed time CFAON to "0". At step 144, the ECU 32 sets the value of the third cooling water temperature THW3 to the smaller value among the present cooling water temperature THW and the third cooling water temperature THW3. The ECU 32 then temporarily terminates subsequent processing. The ECU 32 restarts the routine from step 100 when the next control cycle begins.

When the ECU 32 proceeds to step 150 from step 135, the ECU 32 judges whether the present cooling temperature THW is equal to or above a predetermined reference value of "95.5 degrees Celsius". When it is determined that the cooling water temperature THW is lower than "95.5 degrees Celsius", the ECU 32 proceeds to step 154. If the cooling water temperature THW is equal to or above "95.5 degrees Celsius", the ECU 32 proceeds to step 151.

At step 151, the ECU 32 computes the difference between the values of the present cooling water temperature THW and the third cooling water temperature THW3. The computed result is set as the value of a second altering rate ΔTHW2.

The ECU 32 judges whether the second altering rate ΔTHW2 is equal to or higher than a predetermined reference value of "3 degrees Celsius". When it is determined that the value of the altering rate ΔTHW2 is lower than "3 degrees Celsius", the ECU 32 proceeds to step 154. If the value of the altering rate ΔTHW2 is equal to or higher than "3 degrees Celsius", the ECU 32 proceeds to step 153.

When the ECU 32 proceeds to step 154 from steps 150, 152, the ECU 32 resets a second elapsed time CFAOF to "0" and starts measuring the elapsed time CFAOF so as to prevent generation of chattering during rotation of the fan 18. The ECU 32 then proceeds to step 143 and executes steps 143, 144.

When the ECU 32 proceeds to step 153 from step 152, it is judged whether the second elapsed time CFAOF is equal to or longer than a predetermined reference value of "1 second". If it is determined that the value of the elapsed time CFAOF is shorter than "1 second", the ECU 32 proceeds to step 143 and executes steps 143, 144. If the value of the elapsed time CFAOF is equal to or longer than "1 second", the ECU 32 proceeds to step 155.

When the ECU 32 proceeds to step 155 from steps 130, 141, 153, the ECU 32 stops the rotation of the fan 18 and then sets the fan flag YFA at "0" while resetting the elapsed time CFAOF to "0". At step 156, the ECU 32 increases the first reference value Th1, which is "95 degrees Celsius" and referred to when determining whether to rotate the fan 18, for a predetermined value α. The ECU 32 then executes step 144 and temporarily terminates subsequent processing.

Figures 4A, 4B, 4C, 4D:
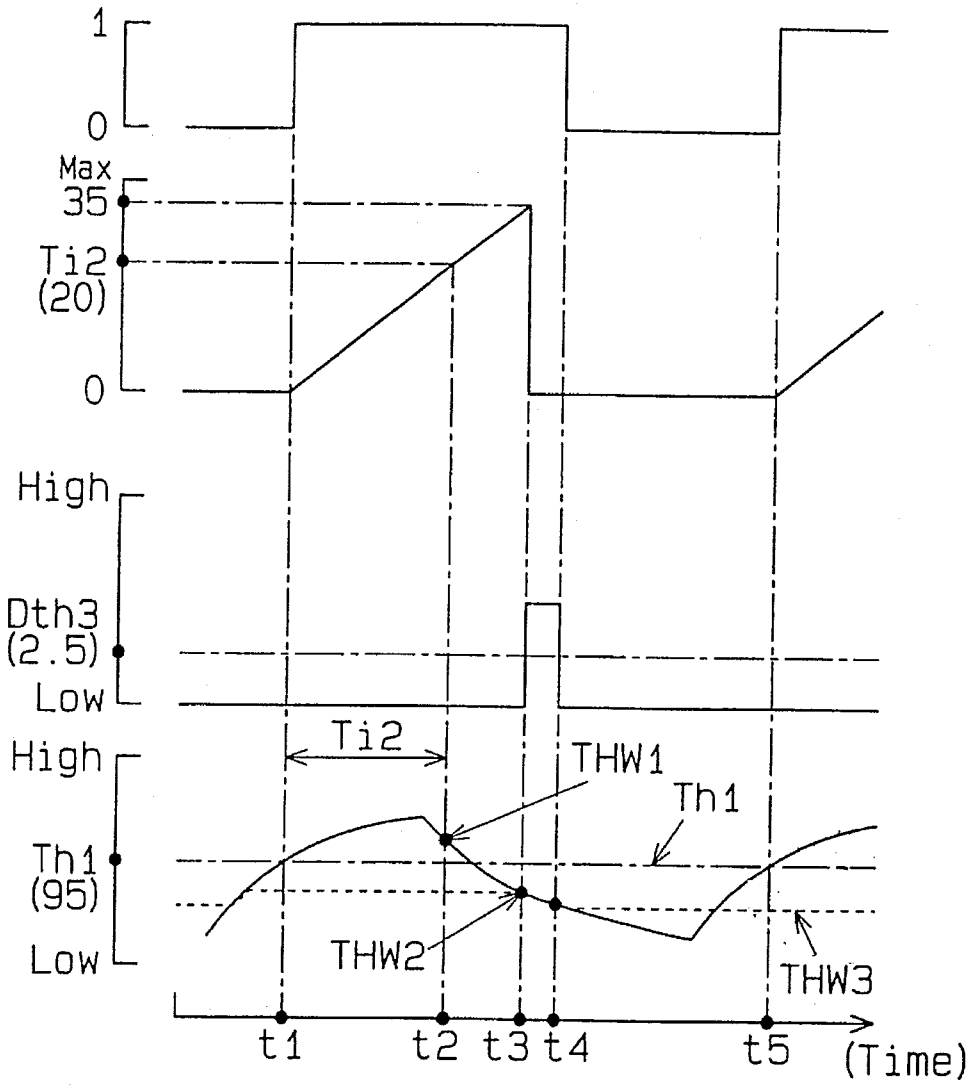
FIGS. 4(*a*) through 4(*d*) are timing charts showing the behavior of various parameters.

The results obtained from the above control routine will now be described. In FIGS. 4(*a*) through 4(*d*), a timing chart shows the behavior of the various parameters of YFA, CFAON, ΔTHW1, THW when the automobile 1 is not moving and the engine 2 is idling.

Here, it is assumed that the radiator 5 is cooled by the opening of the thermostat 7 to the second cooling water passage 14 and the rotation of the fan 18. This adjusts the cooling water temperature THW. In this case, the radiator 5 is cooled only by the air current produced by the fan 18 since an air stream is not produced when the automobile 1 is not moving.

As shown in FIG. 4, when the cooling water temperature THW exceeds "95 degrees Celsius" at time t1, the fan 18 is rotated and the fan flag YFA is changed from "0" to "1". The measurement of the first elapsed time CFAON is simultaneously started. The rotation of the fan 18 starts to lower the value of the cooling water temperature THW in due time.

At time t2, the value of the first cooling water temperature THW1 when the elapsed time CFAON indicates "20 seconds" is detected.

At time t3, the value of the second cooling water temperature THW2 is detected when the elapsed time CFAON indicates "35 seconds". The difference between the values of the second cooling water temperature THW2 and the first cooling water temperature THW1 is computed to obtain the value of the first altering rate ΔTHW1. The value of the altering rate ΔTHW1 here is larger than "2.5 degrees Celsius". This indicates that the opening of the thermostat 7 with respect to the second cooling water passage 14 is large, while the opening of the thermostat 7 between the bypass passage 16 and the second cooling water passage 14 is small. Under such conditions, the cooling effect of the fan 18 is great. Therefore, the rotation of the fan 18 is continued and the fan flag YFA is not changed from "1" to "0" at this point. At time t4, the fan flag YFA is changed from "1" to "0" when the value of the altering rate ΔTHW1 becomes equal to or lower than "2.5 degrees Celsius" and thus stops the rotation of the fan 18.

Afterwards, at time t5, if the cooling water temperature THW exceeds "95 degrees Celsius" again, the fan 18 is rotated and the fan flag YFA is changed to "1" from "0". The measurement of the elapsed time CFAON is simultaneously started.

Figures 5A, 5B, 5C, 5D:
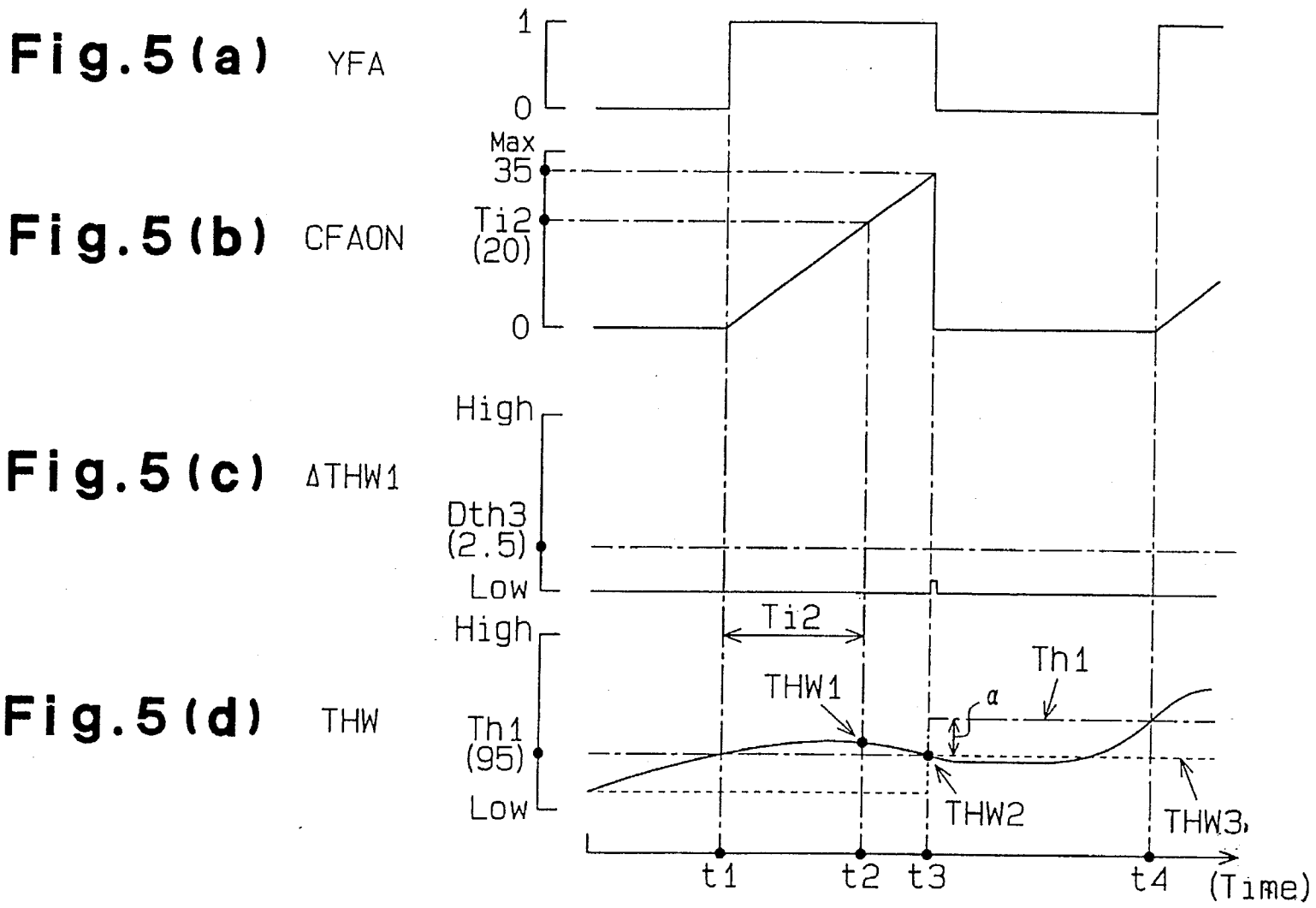
FIGS. 5(*a*) through 5(*d*) are timing charts showing the behavior of various parameters.

In FIGS. 5(*a*) through 5(*b*), a timing chart shows the behavior of the various parameters of YFA, CFAON, ΔTHW1, THW when the automobile 1 is moving.

Here, it is assumed that the radiator 5 is cooled by the air stream produced by the moving automobile 1. As the engine speed rises, the flow rate of the cooling water discharged from the pump 6 increases. In this state, the thermostat 7 is slightly opened to the second cooling water passage 14 to adjust the cooling water temperature THW.

As shown in FIG. 5, when the cooling water temperature THW exceeds "95 degrees Celsius" at time t1, the fan 18 is rotated and the fan flag YFA is changed from "0" to "1". The measurement of the first elapsed time CFAON is simultaneously started. At this point, the alteration of the cooling water temperature THW is small since the radiator 5 is cooled by the air stream produced by the moving automobile 1. In addition to the air stream, the rotation of the fan 18 sends an air current to the radiator 5. This causes the value of the cooling water temperature THW to start slightly falling.

At time t2, the value of the first cooling water temperature THW1 when the elapsed time indicates "20 seconds" is detected.

At time t3, the value of the second cooling water temperature THW2 is detected when the elapsed time CFAON indicates "35 seconds". The difference between the values of the second cooling water temperature THW2 and the first cooling water temperature THW1 is computed to obtain the value of the first altering rate ΔTHW1. The value of the altering rate ΔTHW1 here is smaller than "2.5 degrees Celsius". This indicates that the opening of the thermostat 7 with respect to the second cooling water passage 14 is small, while the opening of the thermostat 7 between the bypass passage 16 and the second cooling water passage 14 is relatively large. Under such conditions, the cooling effect of the fan 18 is small. At this state, the rotation of the fan 18 is immediately stopped and the fan flag YFA is changed from "1" to "0". Furthermore, the predetermined value α is added to the first reference value Th1 of "95 degrees Celsius", which is the value of the cooling water temperature THW that starts the rotation of the fan 18.

Afterwards, if the cooling water temperature exceeds "95+α degrees Celsius" at time t4, the fan 18 is rotated and the fan flag YFA is changed from "0" to "1". The measurement of the elapsed time CFAON is simultaneously started. In this manner, when the fan 18 is temporarily stopped, the predetermined value α is added to the first reference value Th1. Therefore, this ensures the restarting of the rotation of the fan 18 and enables forced cooling of the radiator 5 if an increase in the cooling water temperature THW should occur afterward.

The above structure enables cooling water to circulate between the engine 2 and the block 3 through the jacket 9 and the passages 11, 14, 16. This leads to the cooling of the block 3.

During the circulation, if the cooling water temperature THW becomes equal to or higher than the first reference value Th1 of "95 degrees", the ECU 32 rotates the fan 18 to forcibly cool the radiator 5. The ECU 32 starts measuring the first elapsed time CFAON when the fan 18 begins to rotate. After a time period coinciding with the second reference value Ti2 of "20 seconds" is measured, the ECU 32 obtains the first altering value ΔTHW1 by computing the difference between the value of the second cooling water temperature THW2 detected at "35 seconds" and the first cooling water temperature THW1 detected at "20 seconds".

A rather high altering rate ΔTHW1 value indicates that the cooling effect of the fan 18 with respect to the radiator 5 is great. Thus, in such case, it is important that the fan 18 continues rotation. Contrarily, a rather low value of the altering rate ΔTHW1 indicates that the cooling effect of the fan 18 with respect to the radiator 5 is small. Thus, in such case, the necessity for continuing the rotation of the fan 18 is small. The ECU 32 immediately stops the rotation of the fan 18 when it determines that the value of the altering rate ΔTHW1 is lower than the third reference value Dth3 of "2.5 degrees".

Therefore, the rotation of the fan 18 is immediately stopped when the altering rate ΔTHW1, computed after the fan 18 starts rotation, is rather small. This prevents unnecessary rotation of the fan 18. As a result, forced air cooling of the radiator 5 according to its requirements is optimally controlled by stopping the rotation of the fan 18 in correspondence with the altering rate ΔTHW1 of the cooling water temperature THW.

As described above, when the cooling water temperature THW is rather small and the thermostat 7 is in a slightly opened state, the change in temperature THW of the cooling water flowing out from the radiator 5 is small. The forced air cooling effect of the fan 18 rotated under such conditions is small. This embodiment stops the rotation of the fan 18 when it is determined that the fan 18 need not be operated. Hence, the electric power supply from the battery 20 to the motor 19 is immediately stopped and the motor 19 is operated efficiently. Therefore, power consumption by the motor 19 is reduced. This reduces the electrical load applied to the alternator 21, decreases the load on the engine 2 caused by the operation of the alternator 21, and improves fuel consumption. Furthermore, since the fan 18 is rotated only when necessary, fan noise is reduced.

This embodiment does not require a reference value of the cooling water temperature THW, which is referred to when judging whether to stop the rotation of the fan 18, to be preset at a rather high value. Hence, this prevents the fan 18 from being stopped at a relatively high cooling water temperature THW. As a result, the fan 18 continues rotation when cooling of the radiator 5 is necessary. This allows the block 3 to be steadily cooled.

In this embodiment, the ECU 32 employed to control the engine 2 is also used to control the fan 18. Therefore, a separate cooling water temperature switch to control the fan 18 is unnecessary. This renders machining the block 3 for the mounting of such a switch unnecessary. In this embodiment, the cooling water temperature sensor 31 is provided at the position where the cooling water temperature switch was provided in the prior art. This renders machining the block 3 for the mounting of the sensor 31 unnecessary.

In this embodiment, the ECU 32 eliminates the differences in the cooling water temperature adjusting effect of the cooling apparatus caused by the margin in the set temperature value of the thermostat 7 and the changes resulting from the elapse in time. This reduces the fluctuation of the cooling water temperature THW at the outlet 10 of the jacket 9 in the block 3. Consequently, the combustion of air-fuel mixture in the engine is stabilized, fuel consumption is improved, and knocking is suppressed.

An apparatus for controlling an electrically operated cooling fan in an automobile according to a second embodiment of the present invention will now be described with reference to the drawings. Members that are identical to those employed in the first embodiment are denoted with the same reference numerals in the following embodiments, and these members will thus not be described.

In this embodiment, the first reference value Th1, which is referred to when judging whether to rotate the fan 18, is different from the first embodiment in that it is compensated in accordance with the running condition of the engine 2.

Figure 6:
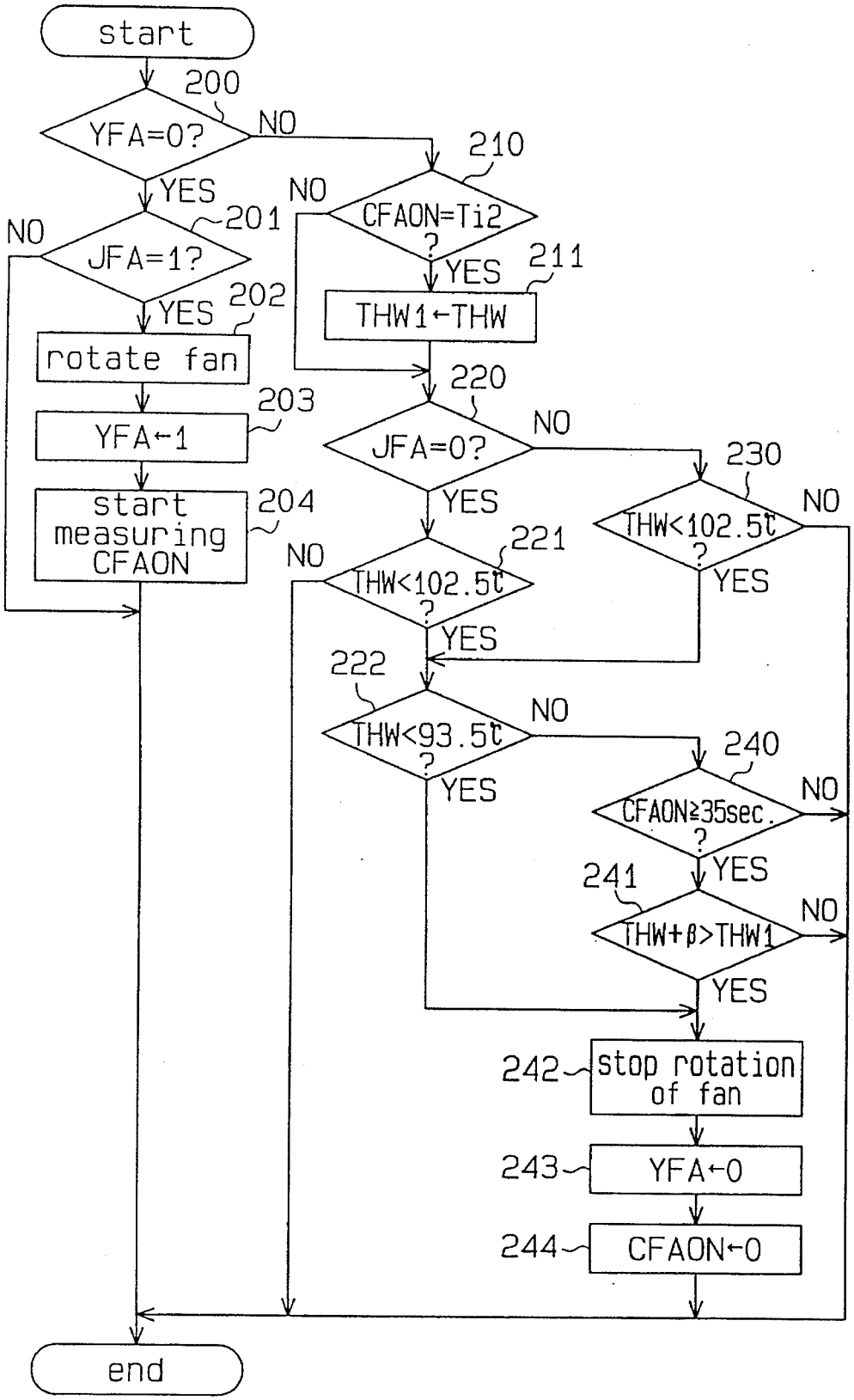
FIG. 6 is a flow chart showing a control routine according to a second embodiment of the present invention.

A flow chart illustrating the control routine utilized to control the fan 18 in this embodiment is shown in FIG. 6. The ECU 32 periodically executes the routine each time a predetermined period of time elapses.

At step 200, the ECU 32 judges whether the fan flag YFA is "0". When it is determined that the fan flag YFA is "1", indicating that the fan 18 is being rotated, the ECU 32 proceeds to step 210. If the fan flag YFA is "0", indicating that fan 18 is not rotating, the ECU 32 proceeds to step 201.

At step 201, the ECU 32 judges whether a conditional flag JFA, which indicates that it is necessary for the fan 18 to be rotated, is set at "1". The ECU 32 sets the value of the conditional flag JFA based on a separate judging routine illustrated in FIG. 7. The ECU 32 periodically executes the judging routine each time a predetermined period of time elapses.

Figure 7:
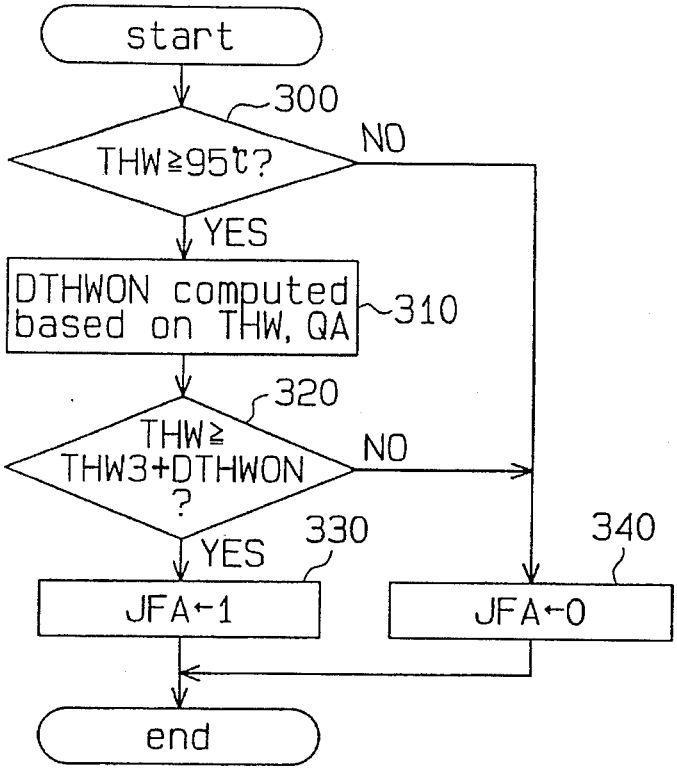
FIG. 7 is a flow chart showing a judging routine.

As shown in FIG. 7, at step 300, the ECU 32 judges whether the cooling water temperature THW is equal to or higher than a predetermined temperature of "95 degrees Celsius". When it is determined that the cooling water temperature THW is lower than "95 degrees Celsius", the ECU 32 proceeds to step 340. If the cooling water temperature is equal to or higher than "95 degrees Celsius", the ECU 32 proceeds to step 310.

At step 310, an increase value DTHWON of the cooling water temperature THW is computed from the values of the cooling water temperature THW and the intake air flow rate QA. The ECU 32 computes the value DTHWON with reference to a predetermined functional data shown in Table 1. In the functional data, the increase value DTHWON becomes smaller as the values of the cooling water temperature THW and the intake air flow rate QA become higher.

TABLE 1

| | THW (°C.) | | | | |
|---|---|---|---|---|---|
| QA (1/sec) | 95.0 | 97.5 | 100 | 102.5 | |
| 5 | 3.5 | 2.5 | 1.0 | 0 | DTHWON |
| 10 | 2.5 | 1.5 | 0.3 | 0 | |
| 15 | 2.0 | 1.0 | 0 | 0 | |
| | | DTHWON | | | |

At step 320, the ECU 32 then judges whether the present cooling water temperature THW is equal to or higher than a value obtained by adding the third cooling water temperature THW3 and the increase value DTHWON. In this embodiment, the sum of the two parameters THW3, DTHWON corresponds to the first reference value Th1. When it is determined that the value of the present cooling water temperature THW is equal to or higher than the sum of the two parameters THW3, DTHWON, indicating that the fan 18 requires rotation, the ECU 32 sets the conditional flag JFA to "1" at step 330. If the cooling water temperature THW is lower than the sum of the two parameters THW3, DTHWON, the ECU 32 proceeds to step 340.

When the ECU 32 proceeds to step 340 from steps 300, 320, the conditional flag JFA is set to "0" since the fan 18 does not require rotation. After the execution of steps 330, 340, the ECU 32 restarts the routine from step 300 when the next control period begins. The conditional flag JFA referred to when judging whether to rotate the fan 18 is set in this manner.

Returning to the routine illustrated in FIG. 6, at step 201, the ECU 32 temporarily terminates subsequent processing if the conditional flag JFA is set at "0", which indicates that the fan 18 does not require rotation. If the conditional flag JFA is set at "1", indicating that the fan 18 requires rotation, the ECU 32 activates the drive circuit 23 to rotate the fan 18 at step 202.

At step 203, the ECU 32 sets the fan flag YFA to "1". At step 204, the ECU 32 starts measuring a first elapsed time CFAON when the fan 18 begins to rotate and then temporarily terminates subsequent processing.

When the ECU 32 proceeds to step 210 from step 200, the ECU 32 judges whether the first elapsed time CFAON coincides with the predetermined reference value Ti2 (e.g., "20 seconds"). When it is determined that the elapsed time CFAON does not coincide with the second reference value Ti2, the ECU 32 proceeds to step 220. If the elapsed time CFAON coincides with the second reference value Ti2, the ECU 32 sets the value of the first cooling water temperature THW1 to the value of the present cooling water temperature THW at step 211 and then proceeds to step 220.

At step 220, the ECU 32 judges whether the conditional flag JFA is set at "0". When it is determined that the conditional flag JFA is set at "1", the ECU 32 proceeds to step 230. If the conditional flag JFA is set at "0", the ECU 32 proceeds to step 221.

The ECU 32 judges whether the cooling water temperature THW is lower than a relatively high predetermined reference value (e.g., "102.5 degrees Celsius") at step 221. When it is determined that the cooling water temperature THW is equal to or higher than the reference value, the ECU 32 temporarily terminates subsequent processing. If the cooling water temperature THW is lower than the predetermined value, the ECU 32 proceeds to step 222.

At step 230, the ECU 32 determines whether the cooling water temperature THW is lower than a value equal to the reference value of step 221 (e.g., 102.5 degrees Celsius). When it is determined that the cooling water temperature is equal to or higher than the predetermined value, the ECU 32 terminates subsequent processing. If the cooling water temperature THW is lower than the reference value, the ECU 32 proceeds to step 222.

When the ECU 32 proceeds to step 222 from steps 221, 230, the ECU 32 judges whether the cooling water temperature THW is lower than a predetermined reference temperature (e.g., 93.5 degrees Celsius), which is slightly lower than the reference value of step 221. When it is determined that the cooling water temperature THW is lower than the reference value, indicating that the fan 18 does not require rotation, the ECU 32 proceeds to step 242. If the cooling water temperature THW is equal to or higher than the reference value, the ECU 32 proceeds to step 240 to judge whether it is necessary to stop the rotation of the fan 18.

At step 240, the ECU 32 judges whether the elapsed time CFAON is equal to or longer than a predetermined reference value (e.g., "35 seconds"). When it is determined that the elapsed time CFAON is shorter than the reference value, the ECU 32 terminates subsequent processing to continue the rotation of the fan 18. If the elapsed time CFAON is equal to or longer than the reference value, the ECU 32 proceeds to step 241.

At step 241, the ECU 32 adds a compensating value β to the value of the present cooling water temperature THW and judges whether the sum is higher than the first cooling water temperature THW1 obtained in step 211. The sum being equal to or lower than the first cooling water temperature THW1 indicates that from the second reference value Ti2 (20 seconds), the altering rate of the cooling water temperature THW in the negative direction is large. Therefore, the ECU 32 terminates subsequent processing to continue the rotation of the fan 18. If the sum is higher than the value of the first cooling water temperature THW1, the altering rate of the cooling water temperature THW in the negative direction is small. Thus, the ECU 32 proceeds to step 242 to stop the rotation of the fan 18.

The ECU 32 stops the rotation of the fan 18 at step 242. At step 243, the ECU 32 sets the fan flag YFA to "0". At step 244, the ECU 32 resets the value of the elapsed time to "0" and temporarily terminates subsequent processing.

The same advantageous effects obtained in the first embodiment are also obtained in this embodiment. In addition, the ECU 32 compensates the value of the first reference value Th1 based on the values of the air intake flow rate QA and the cooling water temperature THW, which reflect the running condition of the engine 2, to judge whether it is necessary to rotate the fan 18. Accordingly, the fan 18 is rotated further optimally when necessary. As a result, the cooling of the radiator 5 is optimally controlled as necessary. This enables cooling to be performed in accordance with changes in the running condition of the engine 2. Hence, the consumption of electric power is further suppressed and the load applied to the engine 2 is further reduced. This further improves the fuel consumption of the engine 2 and reduces the noise of the fan 18.

An apparatus for controlling for an electrically operated cooling fan in an automobile according to a third embodiment of the present invention will now be described with reference to the drawings.

This embodiment differs from the first embodiment in that the second reference value Ti2 and the third reference value Dth3, which are referred to when stopping the rotation of the fan 18, are compensated in accordance with the running condition of the engine 2. In this embodiment, the ECU 32 employs a compensating routine, illustrated in FIG. 8, in addition to the control routine, illustrated in FIGS. 2 and 3, to control the fan 18.

Figure 8:
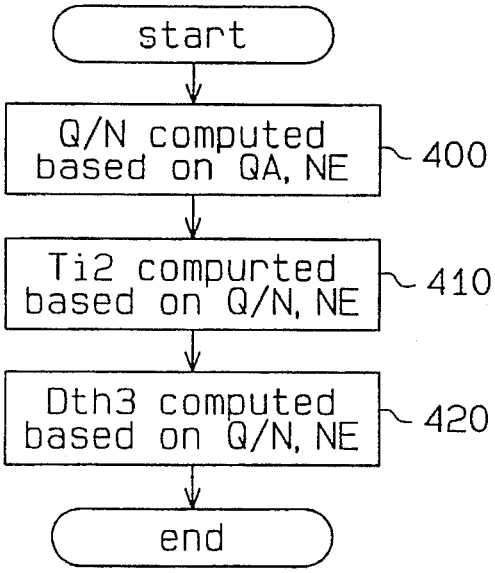
FIG. 8 is a flow chart showing a compensating routine according to a third embodiment of the present invention.
Figure 9:
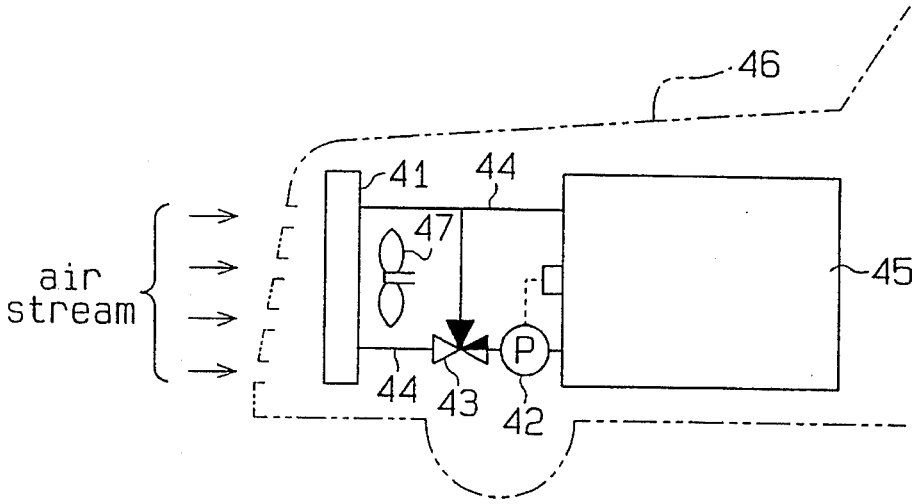
Fig.9(Prior Art)
FIG. 9 is a schematic drawing showing a prior art cooling apparatus.
Figure 10:
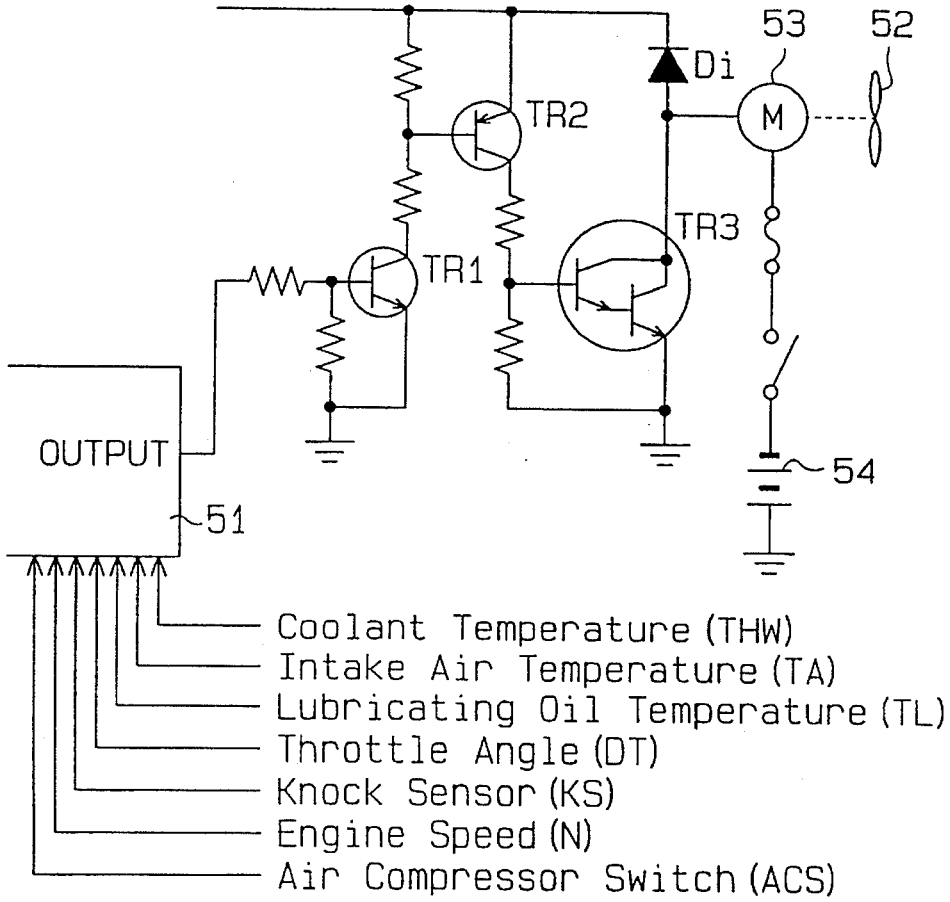
Fig.10(Prior Art)
FIG. 10 is a schematic drawing showing a prior art apparatus for controlling an electrically operated fan.

FIG. 8 shows a flow chart of a compensating routine to compensate the two reference values Ti2, Dth3 in accordance with the running condition of the engine 2. The ECU 32 periodically executes the routine each time a predetermined period of time elapses.

At step 400, the ECU 32 computes the engine load Q/N by dividing the value of the air intake flow rate QA with the value of the engine speed At step 410, the ECU 32 computes the second reference value Ti2 from the values of the engine load Q/N and the engine speed NE. The second reference value Ti2 may be computed from either the engine load Q/N or the engine speed NE. Or the reference value Ti2 may be computed using both parameters Q/N, NE. When computing the reference value Ti2, the ECU 32 refers to a predetermined functional data of the parameters Q/N, NE, Ti2. The length of time during which the cooling water passes through the radiator 5 and reaches the cooling water temperature sensor 31 differs depending on the values of the engine load Q/N and the engine speed ME. In the step 410, the ECU 32 compensates the second reference value Ti2 to reflect the circulating speed of the cooling water.

At step 420, the ECU 32 computes the third reference value Dth3 from the values of the engine load Q/N and the engine speed NE and then temporarily terminates subsequent processing. The third reference value Dth3 may be computed from either one of the parameters Q/N, NE. Or, the reference value Ti2 may be computed using both of the parameters Q/N, NE. When computing the reference value Dth3, the ECU 32 refers to a predetermined functional data of the parameters Q/N, ME, Dth3. The altering rate of the cooling water temperature in the cooling apparatus differs depending on the values of the engine load Q/N and the engine speed NE. In step 420, the ECU 32 compensates the third reference value to reflect the circulating speed of the cooling water.

The ECU 32 applies the two reference values Ti2, Dth3, compensated in the above manner, to the steps 110, 123 of the control routine shown in FIGS. 2 and 3. In other words, when a change in the running condition of the engine 2 occurs, the ECU 32 compensates the two reference values Ti2, Dth3, which are computed using at least one of the values of the engine load Q/N and the engine speed NE. The length of time necessary until the cooling water, cooled in the radiator 5, reaches the cooling water temperature sensor 31 for detection of the cooling water temperature THW value, and the altering rate of the cooling water temperature THW in the cooling apparatus differs according to the conditions of the engine load Q/N and the engine speed NE.

Accordingly, the same advantageous effects obtained in the first embodiment are also obtained in this embodiment. In addition, the altering rate ΔTHW1 of the cooling water temperature THW is optimally computed at step 122, shown in FIG. 2, according to the running condition of the engine 2 by compensating the reference values Ti2, Dth3. Afterward, at step 123, comparison of the altering rate ΔTHW1 with the reference value Dth3 is conducted further optimally. Accordingly, the fan 18 is rotated further optimally when necessary. As a result, the forced air cooling of the radiator 5 is optimally controlled as necessary. This enables cooling to be performed in accordance with changes in the running condition of the engine 2. Hence, the consumption of electric power is further suppressed and the load applied to the engine 2 is further reduced. This further improves the fuel consumption of the engine 2 and the reduces the noise of the fan 18.

Although only three embodiments of the present invention have been described herein, it should be apparent to those skilled in the art that the present invention may be embodied in many other specific forms without departing from the spirit or scope of the invention. Particularly, it should be understood that the present invention may also be modified as described below.

In the above embodiments, the cooling water temperature sensor 31 was located at the intersection of the first cooling water passage 11 and the bypass passage 16. However, the sensor 31 may be located in the second cooling water passage 14 upstream of the thermostat 7 or downstream of the pump 6. Providing the sensor 31 at a position upstream of the thermostat 7 enables the temperature change of the cooling water, discharged from the radiator 5, to be detected precisely with a high response. Hence, this allows the response of the controlling of the fan 18 to be enhanced. Providing the sensor 31 at a position downstream of the pump 6 enables the fan 18 to be controlled in accordance with the cooling water temperature THW in the vicinity of the inlet 15 of the jacket 9.

In the first embodiment, the reference values Th1, Ti2, Dth3 were set at "95 degrees Celsius", "20 seconds", "2.5 degrees Celsius", respectively. However, these values may be appropriately altered depending on the type or displacement of the engine. The apparatus according to the present invention is embodied in the gasoline engine 2 in the above embodiment. However, the apparatus may be embodied in a diesel engine.

Therefore, the present examples and embodiments are to be considered as illustrative and not restrictive and the invention is not to be limited to the details given herein, but may be modified within the scope of the appended claims.

What is claimed is:

1. An apparatus for controlling an electrically operated cooling fan used for an engine cooling device, said engine having a block and a water jacket in the block, wherein said water jacket includes an inlet and an outlet;

said cooling device having a radiator, a first water passage, a second water passage and a water pump;

said radiator having an inlet and an outlet;

said first water passage serving to connect the outlet of the water jacket with the inlet of the radiator to supply the cooling water to the radiator from the water jacket;

said radiator being adapted to receive the cooling water from the first water passage to facilitate heat exchange between air surrounding the radiator and the cooling water so as to decrease the temperature of the cooling water;

said second water passage connecting the outlet of the radiator with the inlet of the water jacket to return the cooling water to the water jacket from the radiator;

said water pump being adapted to force the cooling water to pass through and out of the outlet of the water jacket to the first water passage;

wherein said cooling device circulates the cooling water between the block and the radiator to cool the block and wherein said apparatus controls said cooling fan to forcibly cool the radiator; the apparatus comprises:

detecting means for detecting a temperature of the cooling water;

activating means for activating the cooling fan when said detected water temperature is in excess of a first predetermined reference value;

measuring means for measuring an elapsed time from the actuation of the cooling fan;

computing means for computing a variation rate based on the detected water temperature after when said elapsed time matches a second predetermined reference value; and deactivating means for deactivating the cooling fan when said variation rate is smaller than a third predetermined reference value.

2. The apparatus according to claim 1 further comprising increasing means for increasing the first predetermined reference value with a predetermined supplemental value after the deactivating means deactivates the cooling fan.

3. The apparatus according to claim 1 further comprising:

sensing means for sensing a running condition of the engine; and first correcting means for correcting the first predetermined reference value based on the sensed running condition.

4. The apparatus according to claim 3, wherein said engine includes a crankshaft and draws in air for combustion therein, and wherein said sensing means includes a sensor for sensing the rotational speed of said crankshaft indicative of an engine speed and a sensor for sensing a flow rate of the air drawn in by the engine.

5. The apparatus according to claim 1, said cooling device comprises a third water passage and a thermostat, said third water passage serving to connect the first water passage with the second water passage; said thermostat being adapted to selectively open and close the second water passage based on the temperature of the cooling water; and said third water passage being adapted to directly guide the cooling water in the first water passage to the second water passage when the second water passage is closed by the thermostat.

6. The apparatus according to claim 5, wherein said activating means, said deactivating means, said measuring means and said computing means are included in an electronic control unit.

7. The apparatus according to claim 6, wherein said cooling fan includes an electric motor and a fan actuated by said motor.

8. The apparatus according to claim 7 further comprising supplying means for supplying power to said motor, wherein said electronic control unit controls the power supply to the motor from the supplying means.

9. The apparatus according to claim 8, wherein said supplying means includes a battery, an alternator and a drive circuit, wherein said motor is electrically connected to said battery and said alternator by way of said drive circuit, and wherein said alternator is driven by the engine to generate electric power, and wherein said generated electric power is supplied to the battery and the motor, and wherein said battery is charged by said supplied electric power.

10. The apparatus according to claim 9, wherein said detecting means includes a temperature sensor located at an intersection of the first water passage and the third water passage.

11. The apparatus according to claim 1 further comprising:

sensing means for sensing a running condition of the engine; and second correcting means for correcting the second predetermined reference value based on the sensed running condition.

12. The apparatus according to claim 11 further comprising increasing means for increasing the first predetermined reference value with a predetermined supplemental value after the deactivating means deactivates the cooling fan.

13. The apparatus according to claim 11, wherein said engine includes a crankshaft and draws in air for combustion therein, and wherein said sensing means includes a sensor for sensing rotational speed of said crankshaft indicative of an engine speed and a sensor for sensing a flow rate of the air drawn in by the engine.

14. The apparatus according to claim 13, said cooling device comprises a third water passage and a thermostat, said third water passage connecting the first water passage with the second water passage; said thermostat being adapted to selectively open and close the second water passage based on the temperature of the cooling water; and said third water passage being adapted to directly guide the cooling water in the first water passage to the second water passage when the second water passage is closed by the thermostat.

15. The apparatus according to claim 14, wherein said detecting means includes a temperature sensor located at an intersection of the first water passage and the third water passage.

16. The apparatus according to claim 15, wherein said activating means, said deactivating means, said measuring means and said computing means are included in an electronic control unit.

17. The apparatus according to claim 16, wherein said cooling fan includes an electric motor and a fan actuated by said motor.

18. The apparatus according to claim 17 further comprising supplying means for supplying power to said motor, wherein said electronic control unit controls power supply to the motor from the supplying means.

19. The apparatus according to claim 18, wherein said supplying means includes a battery, an alternator and a drive circuit, wherein said motor is electrically connected to said battery and said alternator by way of said drive circuit, and wherein said alternator is driven by the engine to generate electric power, and wherein said generated electric power is supplied to the battery and the motor, and wherein said battery is charged by said supplied electric power.

20. The apparatus according to claim 1 further comprising:

sensing means for sensing a running condition of the engine; and third correcting means for correcting the third predetermined reference value based on the sensed running condition.

21. The apparatus according to claim 20 further comprising increasing means for increasing the first predetermined reference value with a predetermined supplemental value after the deactivating means deactivates the cooling fan.

22. The apparatus according to claim 20, wherein said engine includes a crankshaft and draws in air for combustion therein, and wherein said sensing means includes a sensor for sensing rotational speed of said crankshaft indicative of an engine speed and a sensor for sensing a flow rate of the air drawn in by the engine.

23. The apparatus according to claim 22, said cooling device comprises a third water passage and a thermostat, said third water passage connecting the first water passage with the second water passage; said thermostat being adapted to selectively open and close the second water passage based on the temperature of the cooling water; and said third water passage being adapted to directly guide the cooling water in the first water passage to the second water passage when the second water passage is closed by the thermostat.

24. The apparatus according to claim 23, wherein said detecting means includes a temperature sensor located at an intersection of the first water passage and the third water passage.

25. The apparatus according to claim 24, wherein said activating means, said deactivating means, said measuring means and said computing means are included in an electronic control unit.

26. The apparatus according to claim 25, wherein said cooling fan includes an electric motor and a fan actuated by said motor.

27. The apparatus according to claim 26 further comprising supplying means for supplying power to said motor, wherein said electronic control unit controls power supply to the motor from the supplying means.

28. The apparatus according to claim 27, wherein said supplying means includes a battery, an alternator and a drive circuit, wherein said motor is electrically connected to said battery and said alternator by way of said drive circuit, wherein said alternator is driven by the engine to generate electric power, said generated electric power is supplied to the battery and the motor, and wherein said battery is charged by said supplied electric power.

29. An apparatus for controlling an electrically operated cooling fan used for an engine cooling device mounted on a automobile, said automobile having a grille on a front side thereof, said electrically operated cooling fan including an electric motor and a fan actuated by said motor, said engine having a block and a water jacket in the block, wherein said water jacket includes an inlet and an outlet, said cooling device having a radiator, a first water passage, a second water passage, a third water passage, a water pump and a thermostat, said radiator having an inlet and an outlet, said radiator being located adjacent to said grill and being adapted to receive an air stream through the grill so as to cool the radiator when the automobile moves forward;

said first water passage connecting the outlet of the water jacket with the inlet of the radiator to supply the cooling water to the radiator from the water jacket;

said radiator being adapted to receive the cooling water from the first water passage to facilitate heat exchange between air surrounding the radiator and the cooling water so as to decrease the temperature of the cooling water;

said second water passage serving to connect the outlet of the radiator with the inlet of the water jacket to return the cooling water to the water jacket from the radiator;

said water pump being adapted to force the cooling water to pass through and out of the outlet of the water jacket to the first water passage;

said third water passage serving to connect the first water passage with the second water passage;

said thermostat being adapted to selectively open and close the second water passage based on the temperature of the cooling water, said third water passage directly guiding the cooling water in the first water passage to the second water passage when the second water passage is closed by the thermostat;

wherein said cooling device circulates the cooling water between the block and the radiator to cool the block, and wherein said apparatus controls said cooling fan to forcibly cool the radiator; the apparatus comprises:

power supplying means for supplying electric power to the motor so as to actuate the cooling fan;

a temperature sensor for detecting a temperature of the cooling water, located at an intersection of the first water passage and the third water passage;

activating means for activating the cooling fan to supply the electric power to the motor from said power supplying means when said detected water temperature is in excess of a first predetermined reference value;

measuring means for measuring an elapsed time from the actuation of the cooling fan;

computing means for computing a variation rate based on the detected water temperature after when said elapsed time matches a second predetermined reference value; and deactivating means for deactivating the cooling fan to cut the electric power to the motor from said power supplying means when said variation rate is smaller than a third predetermined reference value.

* * * * *

UNITED STATES PATENT AND TRADEMARK OFFICE

CERTIFICATE OF CORRECTION

PATENT NO. : 5,609,125

DATED : 11 March 1997

INVENTOR(S) : Masahito NINOMIYA

It is certified that error appears in the above-indentified patent and that said Letters Patent is hereby corrected as shown below:

| Column | Line | |
|---|---|---|
| 11 | 56 | After "temperature" insert --THW--. |
| 12 | 65 | After "speed" insert --NE.--. |
| 13 | 10 | After "speed" change "ME" to --NE--. |
| 13 | 21 | Change "ME" to --NE--. |
| 13 | 22 | After "temperature" insert --THW--. |
| 14 | 15 | After "engine" start new paragraph. |

Signed and Sealed this

Nineteenth Day of August, 1997

*Attest:*

*Attesting Officer*

BRUCE LEHMAN

*Commissioner of Patents and Trademarks*